US007406835B2

(12) United States Patent
Allen et al.

(10) Patent No.: US 7,406,835 B2
(45) Date of Patent: Aug. 5, 2008

(54) COOLING SYSTEM AND METHOD FOR COOLING A HEAT PRODUCING SYSTEM

(75) Inventors: David J. Allen, Gladstone, MI (US); Mark S. Bader, Gladstone, MI (US); Robert D. Chalgren, Jr., Duluth, MN (US); Michael P. Lasecki, Gladstone, MI (US); Michael W. Martin, Gladstone, MI (US); Keith Brannstrom, Rapid River, MI (US)

(73) Assignee: EMP Advanced Development, LLC, Escanaba, MI (US)

( * ) Notice: Subject to any disclaimer, the term of this patent is extended or adjusted under 35 U.S.C. 154(b) by 472 days.

(21) Appl. No.: 11/125,440

(22) Filed: May 10, 2005

(65) Prior Publication Data

US 2006/0254291 A1 Nov. 16, 2006

(51) Int. Cl.
*F25D 17/00* (2006.01)
*F01P 7/02* (2006.01)
*F01P 9/02* (2006.01)

(52) U.S. Cl. ..... 62/179; 62/180; 62/519; 62/525; 236/34; 123/41.02; 123/41.09; 123/41.44; 123/41.65; 165/97; 165/101

(58) Field of Classification Search ..... 62/179, 62/519, 524, 525, 180; 236/34; 123/41.02, 123/41.08, 41.09, 41.44, 41.65; 165/97, 165/101
See application file for complete search history.

(56) References Cited

U.S. PATENT DOCUMENTS 4,382,481 A 5/1983 Moore
4,519,343 A 5/1985 Hayashi et al.
4,590,892 A 5/1986 Nose et al.
4,658,595 A * 4/1987 Shimada et al. ..... 62/179
4,726,325 A * 2/1988 Itakura ..... 123/41.1
5,180,003 A 1/1993 Kouzel et al.
5,771,961 A 6/1998 Alizadeh
5,992,514 A 11/1999 Sugimoto et al.
6,155,335 A 12/2000 Acre et al.
6,401,801 B1 6/2002 Dicke
6,463,891 B2 10/2002 Algrain et al.
6,743,539 B2 6/2004 Clingerman et al.
6,809,484 B2 10/2004 Makaran et al.
6,817,831 B2 11/2004 Stevens et al.
6,832,644 B2 12/2004 Stauder et al.
6,840,743 B2 1/2005 Herke et al.
6,886,624 B2 5/2005 Zobel et al.
2005/0006048 A1 1/2005 Vuk
2005/0028756 A1 2/2005 Santanam et al.

* cited by examiner

*Primary Examiner*—Marc E Norman
(74) *Attorney, Agent, or Firm*—Brooks Kushman P.C.

(57) ABSTRACT

A cooling system for cooling a plurality of heat producing systems includes a heat exchanger having a plurality of cooling zones, each of which has a respective inlet and outlet for facilitating flow of a respective temperature control fluid therethrough. Each of the respective temperature control fluids facilitates temperature control of a respective heat producing system. A plurality of fans cool the temperature control fluids flowing through the heat exchanger, and a fan or fans are disposed proximate each zone of the heat exchanger to provide air flow substantially independently from the air flow over the other cooling zones.

25 Claims, 3 Drawing Sheets

COOLING SYSTEM AND METHOD FOR COOLING A HEAT PRODUCING SYSTEM

BACKGROUND OF THE INVENTION

1. Field of the Invention

The present invention relates to a cooling system and method for cooling a heat producing system.

2. Background Art

Vehicles today are under an ever increasing demand to do more in less space. For example, an engine in a large commercial vehicle will typically provide torque to power the vehicle, and will also provide power to a variety of vehicle subsystems. Some of these subsystems may be driven directly by the engine through a mechanical link, while others may be operated by electrical power received from a generator, which itself is connected to the engine. As the number of these vehicle subsystems increases, so too does the demand on the engine. Therefore, there is a need to ensure an adequate cooling system for the engine so that it does not overheat or cause damage to vehicle components in close proximately to it. In addition, increasingly stringent emissions requirements can place additional demands on an engine cooling system, as the overall thermal output of the engine is closely managed to help meet the emissions requirements.

The increasing number of requirements placed on engines can be the cause of increased size and complexity of the engine and its subsystems, including its thermal management system. This is at a time when there is a push toward smaller packaging to reduce vehicle size and weight and further increase fuel economy. Of course, many of these same concerns are present in other heat producing systems, for example a fuel cell or an engine used to drive an electrical generator, just to name two. In addition, other systems within a vehicle—i.e., systems other than the engine—may also require thermal management, further increasing the size and complexity of the thermal management system.

One example of a fan control system and method used for heat dissipation is described in U.S. Pat. No. 6,463,891 issued to Algrain et al. on Oct. 15, 2002. Algrain et al. discusses the use of a dual fan system, where the fans supply cooling air to a number of different heat exchangers. The various heat exchangers are used to cool different systems which may have different cooling needs. One limitation of the system described in Algrain et al., is that each fan moves air through more than one heat exchanger. At any given time, the system associated with one heat exchanger may require cooling, while the system associated with a second heat exchanger may not require cooling, and yet both these heat exchangers are fed by the same fan.

This is similar to the heat exchanger described in U.S. Pat. No. 5,992,514 issued to Sugimoto et al. on Nov. 30, 1999. Sugimoto et al. describes a single heat exchanger having several exchanging portions; however, a single fan is used to simultaneously cool all the portions of the heat exchanger. Like the system described in Algrain et al., the system described in Sugimoto et al. lacks a means to individually control each portion of the heat exchanger separately. This can lead to over cooling systems serviced by one portion of the heat exchanger, and undercooling systems serviced by another portion of the heat exchanger.

Therefore, it would be desirable to save space by utilizing a single heat exchanger in a cooling system that could be used to cool a variety of different heat producing systems. Such a heat exchanger would have different cooling zones that could be dedicated to individual heat producing systems, and would also have one or more fans associated with each cooling zone that could supply cooling air to each zone independently of air supplied to the other cooling zones.

SUMMARY OF THE INVENTION

The present invention provides a cooling system for cooling a plurality of heat producing systems. The cooling system includes a heat exchanger including first and second cooling zones. The first cooling zone includes a first inlet for receiving a first temperature control fluid from a first of the heat producing systems and a first outlet for returning the first temperature control fluid to the first heat producing system. The second cooling zone includes a second inlet for receiving a second temperature control fluid from a second of the heat producing systems, and a second outlet for returning the second temperature control fluid to the second heat producing system. A first fan assembly is disposed proximate the first zone, and includes a first fan that is operable to move air across the first zone substantially independently of air moving across any other zone of the heat exchanger. This facilitates cooling of the first temperature control fluid as it passes through the first zone. A second fan assembly is disposed proximate the second zone and includes a second fan that is independently operable from the first fan. The second fan moves air across the second zone substantially independently of air moving across any other zone of the heat exchanger. This facilitates cooling of the second temperature control fluid as it passes through the second zone.

The invention also provides a cooling system for a vehicle including a plurality of vehicle systems. The cooling system includes a heat exchanger including a plurality of cooling zones, each of which has a respective inlet and outlet for facilitating the flow of a respective temperature control fluid therethrough. Each of the respective temperature control fluids facilitates temperature control of a respective vehicle system. The heat exchanger is configured such that each of the temperature control fluids are separated from the other temperature control fluids. A plurality of fans are provided for cooling the temperature control fluids flowing through the heat exchanger. As least one of the fans is disposed proximate each of the cooling zones for moving air across a respective cooling zone substantially independently of air moving across any of the other cooling zones. This facilitates independent temperature control for each cooling zone.

The invention further provides a method of cooling a plurality of heat producing systems utilizing a heat exchanger having a cooling zone for each of the heat producing systems and a plurality of fans for moving air across the heat exchanger. The method includes circulating a respective temperature control fluid through each of the cooling zones. At least one of the fans is operated to move air across substantially only one of the cooling zones, thereby facilitating temperature control fluid of a respective heat producing system substantially independently of any other of the heat producing systems.

DETAILED DESCRIPTION

Figure 1:
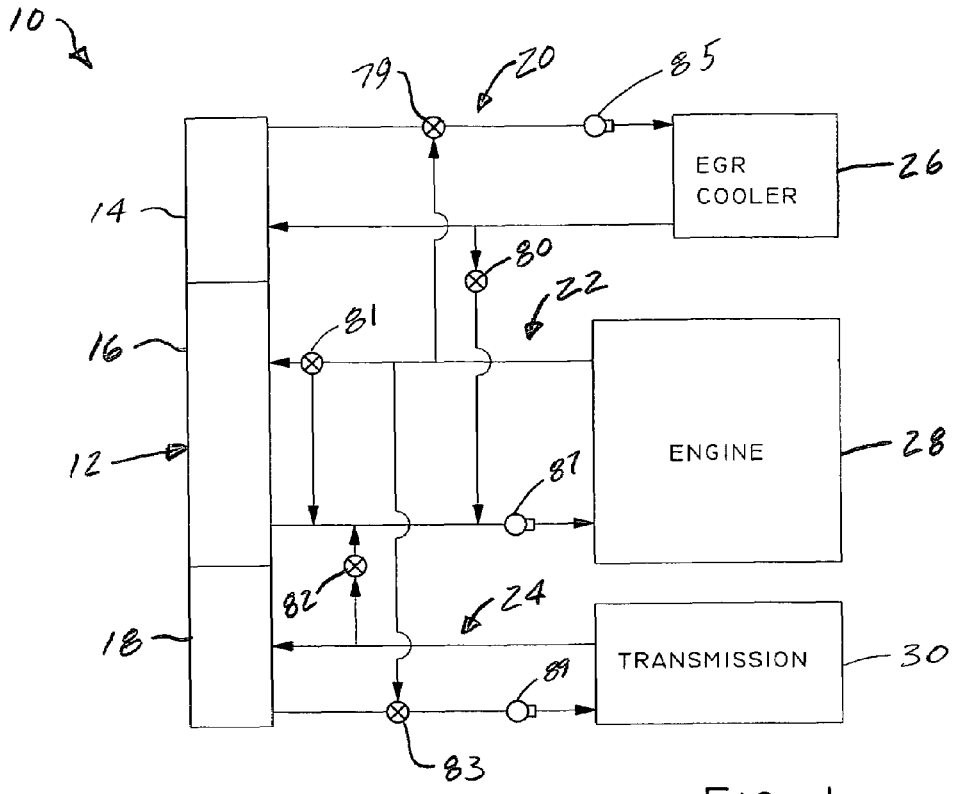
FIG. 1 is a schematic representation of one embodiment of a cooling system in accordance with the present invention.

FIG. 1 shows a portion of a cooling system 10 in accordance with one embodiment of the present invention. The cooling system 10 includes a heat exchanger 12 that is divided into first, second and third cooling zones 14, 16, 18. Each of the cooling zones 14, 16, 18 is respectively associated with a separate cooling loop 20, 22, 24 which is in communication with a respective heat producing system. The heat producing systems shown in FIG. 1 include an EGR cooler 26, an engine 28, and a transmission 30. Although the heat producing systems illustrated in FIG. 1 represent components of a vehicle, it is understood that a cooling system in accordance with the present invention can also be used with non-vehicle related heat producing systems, for example, an engine used to power a generator to produce electricity. Moreover, although FIG. 1 illustrates a heat exchanger having three cooling zones which respectively service three different heat producing systems, the present invention may include a heat exchanger having less than three or greater than three cooling zones.

Figure 2:
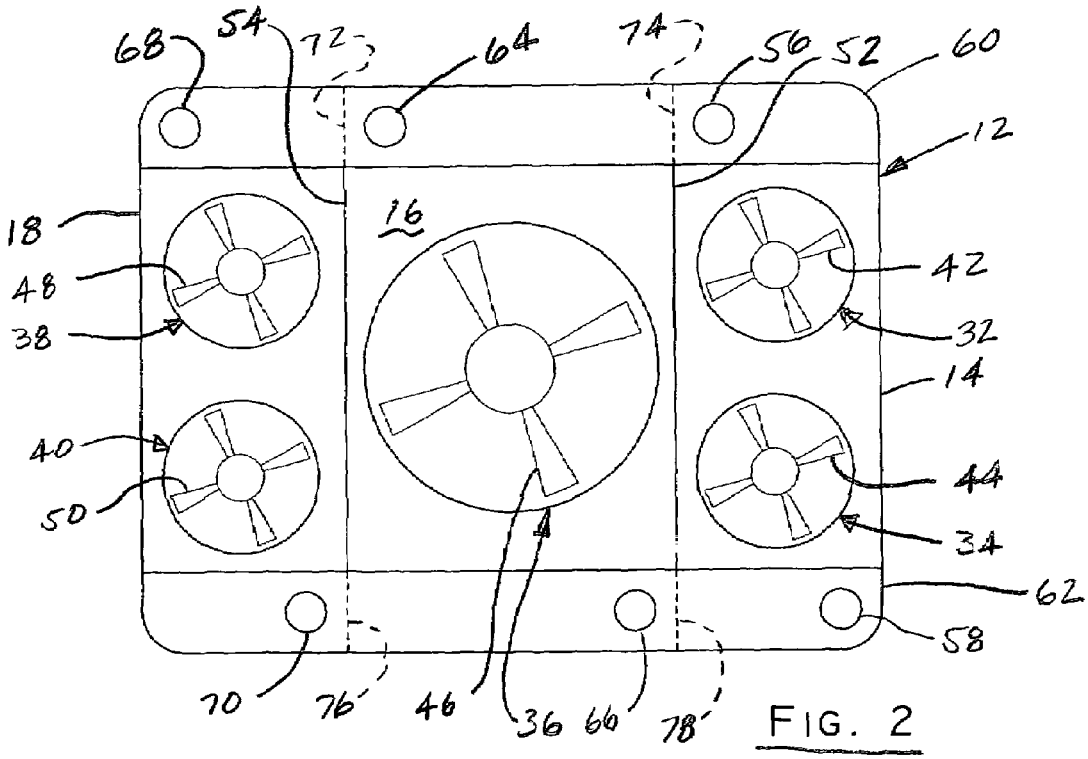
FIG. 2 is a back plan view of a heat exchanger and fan assembly in accordance with an embodiment of the present invention.

FIG. 2 shows a back plan view of the heat exchanger 12 including a number of fan assemblies 32, 34, 36, 38, 40. Each of the fan assemblies 32, 34, 36, 38, 40 respectively includes a fan 42, 44, 46, 48, 50. As shown in FIG. 2, each of the zones 14, 16, 18 of the heat exchanger 12 includes at least one fan which is operable to move air across its respective zone substantially independently of the air moving across the other zones by the other fans. For example, the fans 42, 44 are dedicated to moving air across the first zone 14, and the air that is being moved by the fans 42, 44 is inhibited from flowing across the second cooling zone 16 by the use of a divider 52. Similarly, the fan assembly 36 is configured such that the air moved by the fan 46 is dedicated to the second cooling zone 16. In particular, the divider 52 inhibits air moved by the fan 46 from moving across the first zone 14. A divider 54 inhibits the air moved by the fan 46 from moving across the third cooling zone 18. The divider 54 also inhibits air moved by the fans 48, 50 from moving across the second cooling zone 16.

It is understood that the dividers 52, 54 may completely isolate the air moved by any of the fans so that it remains in one particular cooling zone; however, it is also understood that the dividers 52, 54 may not form a completely air tight seal and it is possible that some small amount of air traverses more than one cooling zone. Any such small amount of air that passes into an adjacent cooling zone will be negligible with regard to the thermal management of the heat producing system serviced by the adjacent cooling zone. Thus, each of the fans are operable to move air across a dedicated cooling zone substantially independently from the air moving across any of the other cooling zones. Although the embodiment of the present invention shown in FIG. 2 includes dividers between the cooling zones, as explained more fully below, it is also possible to use individual fan shrouds which may be integrated as a part of the fan assembly, to control movement of air over a single cooling zone.

As described above in conjunction with FIG. 1, each of the cooling zones 14, 16, 18 are part of respective cooling loops 20, 22, 24. Each of the cooling loops 20, 22, 24 includes a respective temperature control fluid, such as a mixture containing glycol and water, or some other cooling medium. Of course, other types of temperature control fluids may be utilized, for example, in the case of the transmission 30, the cooling zone 18 may receive the transmission oil directly, rather than a separate fluid which exchanges heat with the transmission oil. The fans 42, 44, 46, 48, 50, shown in FIG. 2, move air across their respective cooling zones, thereby cooling their respective temperature control fluids. Of course, depending on the configuration of the particular fan assembly, an individual fan may not move air across its entire cooling zone, but rather, may move air over only a portion of its cooling zone. For example, the fans 42, 44 can be independently controlled so that if only a small amount of cooling is required, only one of the fans 42, 44 is operated, thereby saving energy and effectively managing the temperature of the associated heat producing system. To facilitate independent operation of the fans 42, 44, 46, 48, 50, they can be equipped with electric motors. In addition, one or more of the fans can be mechanically driven by the engine 28.

As shown in FIG. 2, the cooling zone 14 includes an inlet 56 and an outlet 58 respectively located in headers 60, 62 of the heat exchanger 12. Similarly, the second cooling zone 16 includes an inlet 64 and an outlet 66, while the third cooling zone 18 includes an inlet 68 and an outlet 70. The inlets 56, 64, 68, and the outlets 58, 66, 70, respectively provide ingress and egress for the respective temperature control fluids passing through each of the cooling zones 14, 16, 18. As shown in FIG. 2, baffles 72, 74, 76, 78 are used to separate the temperature control fluids from each other, so that each one only flows through its respective cooling zone 14, 16, 18.

As shown in FIG. 1, valves 79, 80, 81, 82, 83 may be disposed between the coolant loops 20, 22, 24 to allow for selective mixing of the temperature control fluids between the coolant zones 14, 16, 18. Such a configuration adds additional flexibility to the cooling system 10. For example, the valves 79, 80, 81 can be appropriately actuated to allow hot temperature control fluid from the EGR coolant loop 20 to be mixed with the temperature control fluid from the engine coolant loop 22. This could provide a quicker warmup time for the engine 28, which may be particularly important during cold start conditions. In addition, the valves 82, 83 can be appropriately actuated to provide warm temperature control fluid to the transmission coolant loop 24, thereby more quickly heating the transmission 30.

In addition to providing a mechanism for faster warmups, the valves 79-83 provide another advantage by allowing a redundant pumping scheme. The temperature control fluids are pumped through the coolant loops 20, 22, 24 by respective fluid pumps 85, 87, 89. If any one of the fluid pumps 85, 87, 89 is incapable of providing an adequate volume of fluid flow through its respective coolant loop, the appropriate valves can be actuated to allow one or both of the remaining pumps to compensate. It is worth noting that although the valves 79-83 may be thermostatic valves, it may be convenient to utilize electronic valves that can be controlled within an integrated control system configured to actuate the fans 42, 44, 46, 48, 50, as well as the fluid pumps 85, 87, 89.

Figure 3:
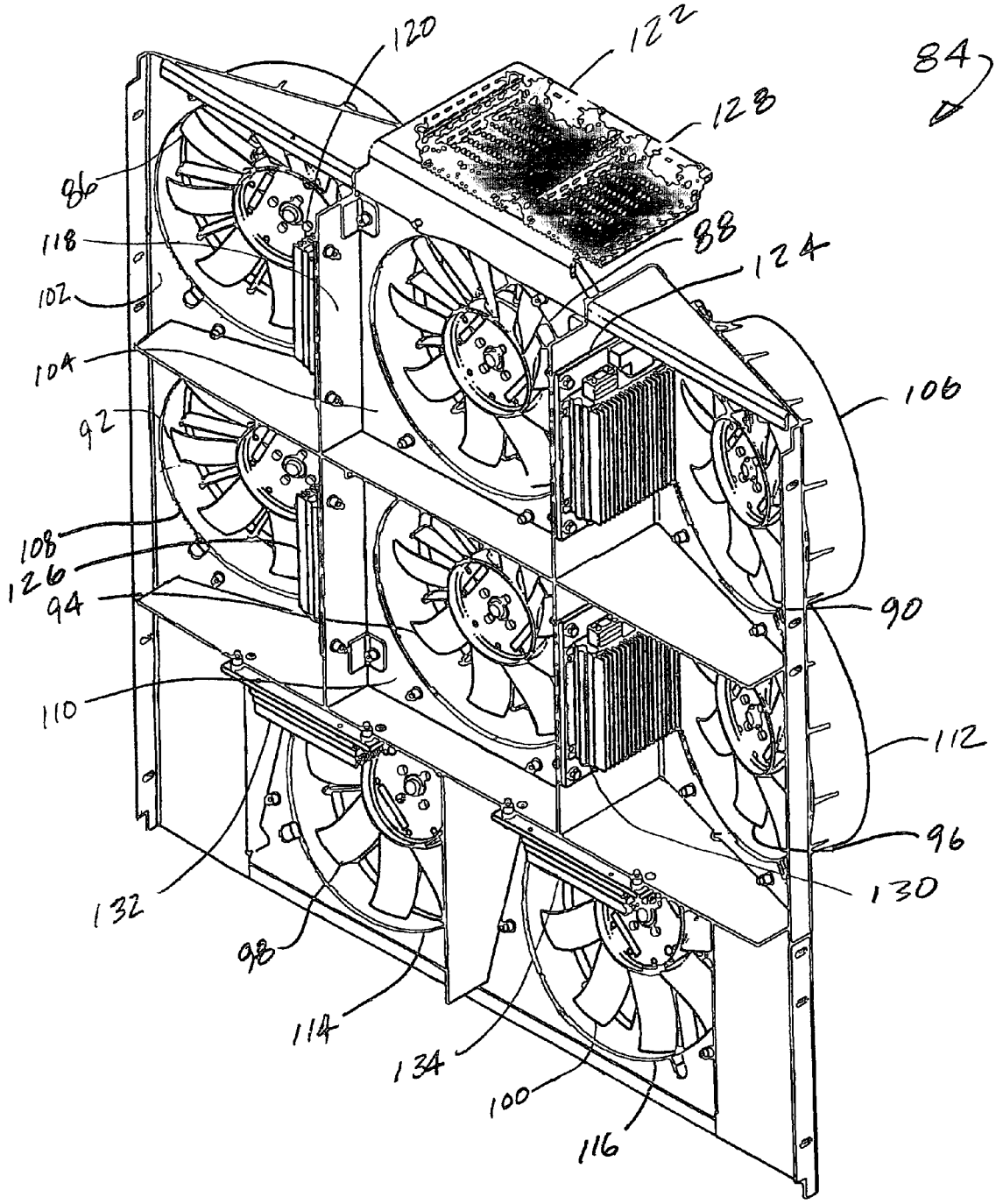
FIG. 3 is a perspective view of a fan and shroud assembly in accordance with an embodiment of the present invention.

As described above, the dividers 52, 54, shown in FIG. 2, provide a means for keeping the air flow over the respective cooling zones 14, 16, 18 substantially independent from the air flow over any of the other cooling zones. As an alternative to providing dividers across a heat exchanger, such as illustrated in FIG. 2, individual shrouds can be used as part of a fan assembly to direct the air generated by its respective fan and to inhibit mixing of the air moved by the other fans. FIG. 3 shows a fan and shroud assembly 84. In particular, eight fans 86, 88, 90, 92, 94, 96, 98, 100 are mounted within respective fan shrouds 102, 104, 106, 108, 110, 112, 114, 116. As shown in FIG. 3, the shrouds 102, 106, 108, 112 orient their respective fans 86, 90, 92, 96 at an angle, in toward the center of the fan and shroud assembly 84. Such a configuration may provide a number of different advantages. For example, angling the fans inward at the outer edges can reduce the overall width of a fan and heat exchanger assembly. This may be particularly important in situations where space is at a premium.

Another advantage is that angling the fans inward at the edges may direct a greater amount of air flow over a heat producing system, such as an engine, which is disposed behind the center of the heat exchanger. As shown in FIG. 3, the shrouds 102, 104, 106, 108, 110, 112, 114, 116 not only help to direct the air flow from their respective fans, but also keep the air flow from each fan substantially separate from the air flow of the other fans. As shown in FIG. 3, each of the shrouds 102, 104, 106, 108, 110, 112, 114, 116 circumferentially surrounds at least a portion of its respective fan. Moreover, at least some of the shrouds extend outward to further direct the flow of air from its respective fan. For ease of manufacture, each fan shroud can be made substantially the same, or some of them can be specially configured, such as in the fan and shroud assembly 84. Because the fans 86, 90, 92, 96 are angled inward, there is no need to have a large divider along their outer edge. Moreover, shrouds which are adjacent to each other, such as the shrouds 102, 104, may share a common divider wall, such as the wall 118. This allows one of the shrouds to include the wall 118, while the other shroud can be left open on one side, thereby saving production costs.

As shown in FIG. 3, each of the fans 86, 88, 90, 92, 94, 96, 98, 100 includes its own controller 120, 122, 124, 126, 128, 130, 132, 134. Having individual controllers provides a convenient way to individually control each of the fans 86, 88, 90, 92, 94, 96, 98, 100. It is understood, however, that the present invention contemplates the use of a single controller to control multiple fans. As shown in FIG. 3, most of the controllers are mounted adjacent a respective fan on a portion of the shroud. Two of the controllers 122, 128, however, are mounted at the top of the fan and shroud assembly 84, so as to avoid having two controllers mounted directly opposite each other on a portion of a shroud wall. This helps to avoid undesirable heat build up that could be generated with two controllers in close proximity to each other.

With the exception of the controllers 122, 128, the remaining controllers are disposed within the air flow path of a respective fan, which helps to keep the controller cool when the fan is in use. Moreover, each of the shrouds can be made from a heat conductive material so that when a controller is mounted to it, it dissipates heat into the shroud. Each of the controllers 120, 122, 124, 126, 128, 130, 132, 134 may be part of an integrated control system which controls not only operation of the fans, but also operation of valves, such as the valves 79-83, shown in FIG. 1, and/or the pumps 85, 87, 89.

Figure 5:
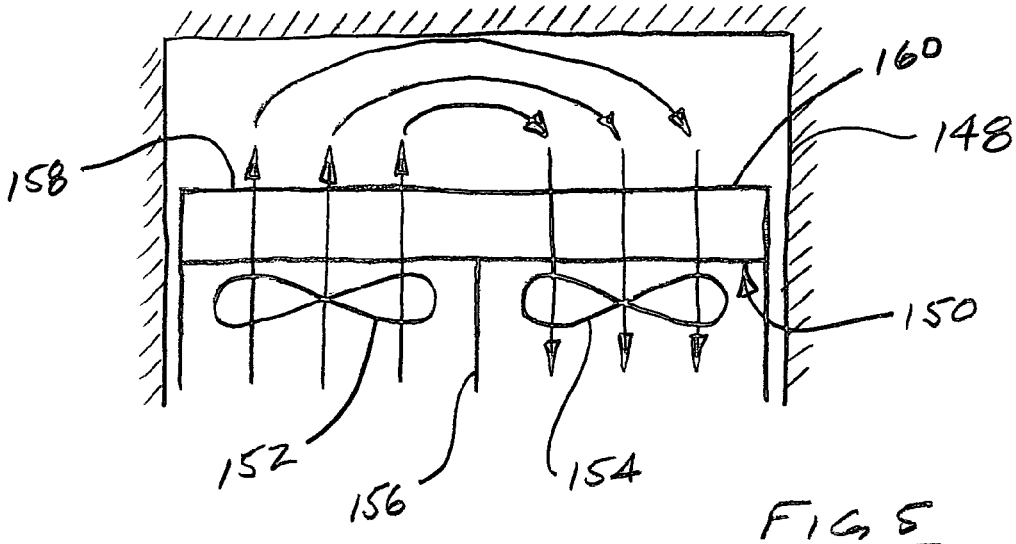
FIG. 5 is a schematic representation of a portion of a cooling system in accordance with an embodiment of the present invention.
Figure 4:
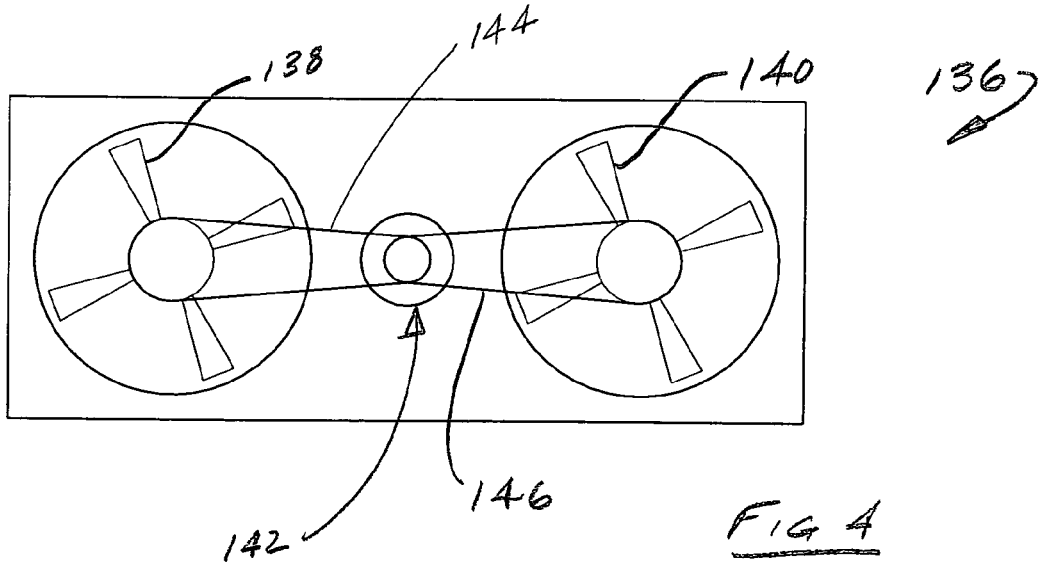
FIG. 4 is a fan and shroud assembly in accordance with another embodiment of the present invention.

As shown in FIGS. 4 and 5, some embodiments of the present invention can provide additional space savings. For example, FIG. 4 shows a fan and shroud assembly 136 that includes two fans 138, 140, both of which are controlled by a single motor 142. The motor 142 can be connected to the fans 138, 140 by power transmission devices, such as belts 144, 146. Because the motor 142 may operate both fans 138, 140 simultaneously, it may be most advantageous to have such an arrangement covering a single cooling zone, with additional cooling zones having fans operated by a separate motor or motors. Of course, a single motor, dual fan arrangement, such as shown in FIG. 4, could include a clutch or other mechanism for independent actuation of the fans.

In some situations, it may not be possible to move air through a heat exchanger in one direction only. Rather, it may be necessary to move air through a portion of the heat exchanger in one direction, and than move it back through another portion of the heat exchanger to be exhausted through an outlet. FIG. 5 is a schematic illustration of one situation in which a tightly enclosed space 148 can be effectively utilized with an embodiment of the present invention. In particular, a heat exchanger 150 is located within the space 148, which, as shown in FIG. 5, does not have a large outlet for air that is blown into the space 148. Therefore, the present invention contemplates the use of two fans 152, 154 which move air in opposite directions.

In particular, the fan 152 blows air through the heat exchanger 150 into the space 148, while the fan 154 pulls air back through the heat exchanger 150 and out of the space 148. As in other embodiments, the movement of the air by each of the fans 152, 154 is substantially independent of the air moved by the other fan. This is facilitated by the use of a divider 156 disposed between the two fans 152, 154. As shown in FIG. 4, the heat exchanger 150 can be divided into two separate cooling zones 158, 160 wherein the air is moved in different directions over each cooling zone. Alternatively, the heat exchanger 150 may have different cooling zones wherein each cooling zone utilizes the movement of air in both directions.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A cooling system for cooling a plurality of heat producing systems, the cooling system comprising:

a heat exchanger including first and second cooling zones, the first cooling zone including a first inlet for receiving a first temperature control fluid from a first of the heat producing systems and a first outlet for returning the first temperature control fluid to the first heat producing system, the second cooling zone including a second inlet for receiving a second temperature control fluid from a second of the heat producing systems and a second outlet for returning the second temperature control fluid to the second heat producing system;

a first fan assembly disposed proximate the first zone and including a first fan operable to move air across the first zone substantially independently of air moving across any other zone of the heat exchanger, thereby facilitating cooling of the first temperature control fluid as it passes through the first zone;

a second fan assembly disposed proximate the second zone and including a second fan independently operable from the first fan to move air across the second zone substantially independently of air moving across any other zone of the heat exchanger, thereby facilitating cooling of the second temperature control fluid as it passes through the second zone;

a first shroud disposed proximate the first fan and configured to direct the air moved by the first fan through the heat exchanger, and further configured to inhibit mixing of the air moved by the first and second fans;

a second shroud disposed proximate the second fan and configured to direct the air moved by the second fan through the heat exchanger, at least one of the shrouds including a heat conductive material; and a control system for controlling operation of the first and second fans and including a controller attached to a portion of the heat conductive material for dissipating heat from the controller.

2. The cooling system of claim 1, wherein the heat exchanger is configured to keep the first and second temperature control fluids separate from each other, thereby facilitating independent temperature control of the first and second heat producing systems.

3. The cooling system of claim 1, further comprising a valve operable to allow selective mixing of the first and second temperature control fluids, thereby facilitating heat transfer between the first and second temperature control fluids.

4. The cooling system of claim 1, further comprising one motor for operating the first and second fans.

5. The cooling system of claim 1, wherein the heat exchanger further includes additional cooling zones, each of the additional cooling zones including an inlet and an outlet for facilitating the flow of a respective temperature control fluid through the respective cooling zone, each of the respective temperature control fluids facilitating temperature control of a respective heat producing system, the cooling system further comprising additional fan assemblies, each of the additional fan assemblies being disposed proximate a respective additional cooling zone and including a respective fan.

6. The cooling system of claim 1, further comprising a plurality of the first fan assemblies, each of the first fan assemblies being disposed proximate the first zone and including a respective fan operable to move air across the first zone substantially independently of air moving across any other zone of the heat exchanger.

7. The cooling system of claim 6, wherein at least one of the first fans is operable independently of at least one of the other first fans.

8. The cooling system of claim 1, further comprising a divider disposed between the first and second fans for inhibiting mixing of the air moved by the first and second fans.

9. The cooling system of claim 1, wherein the controller is disposed on a portion of at least one of the shrouds in an air flow path of at least one of the fans, thereby being cooled by the air moved by the at least one fan.

10. The cooling system of claim 1, wherein the first and second fans are disposed on one side of the heat exchanger, and the first fan is configured to push air through the heat exchanger and the second fan is configured to pull air through the heat exchanger.

11. The cooling system of claim 1, further comprising a control system including a controller, the controller being configured to control operation of the first and second fans.

12. A cooling system for a vehicle including a plurality of vehicle systems, the cooling system comprising:

a heat exchanger including a plurality of cooling zones, each of the cooling zones having a respective inlet and outlet for facilitating the flow of a respective temperature control fluid therethrough, each of the respective temperature control fluids facilitating temperature control of a respective vehicle system, the heat exchanger being configured such that each of the temperature control fluids are separated from the other temperature control fluids;

a plurality of fans for cooling the temperature control fluids flowing through the heat exchanger, at least one of the fans being disposed proximate each of the cooling zones for moving air across a respective cooling zone substantially independently of air moving across any of the other cooling zones, thereby facilitating independent temperature control for each cooling zone;

a plurality of shrouds disposed proximate respective fans for directing, and inhibiting mixing of, the air moved by the respective fans; and a control system for controlling operation of the fans and including a controller, the controller being disposed on a portion of at least one of the shrouds in an air flow path of at least one of the fans, thereby being cooled by the air moved by the respective fan.

13. The cooling system of claim 12, further comprising one motor for operating at least two of the fans.

14. The cooling system of claim 12, wherein a plurality of the fans are disposed proximate the same cooling zone.

15. The cooling system of claim 14, wherein two of the fans disposed proximate the same cooling zone are operable independently of each other.

16. The cooling system of claim 12, further comprising a divider disposed between at least two of the fans which are disposed proximate different cooling zones for separating the air flow across respective cooling zones.

17. The cooling system of claim 12, wherein at least one of the shrouds includes a heat conductive material, and the controller is attached to a portion of the heat conductive material for dissipating heat from the controller.

18. A cooling system for cooling a plurality of heat producing systems, the cooling system comprising:

a heat exchanger including first and second cooling zones, the first cooling zone including a first inlet for receiving a first temperature control fluid from a first of the heat producing systems and a first outlet for returning the first temperature control fluid to the first heat producing system, the second cooling zone including a second inlet for receiving a second temperature control fluid from a second of the heat producing systems and a second outlet for returning the second temperature control fluid to the second heat producing system;

a first fan assembly disposed proximate the first zone and including a first fan operable to move air across the first zone substantially independently of air moving across any other zone of the heat exchanger, thereby facilitating cooling of the first temperature control fluid as it passes through the first zone; and a second fan assembly disposed proximate the second zone and including a second fan independently operable from the first fan to move air across the second zone substantially independently of air moving across any other zone of the heat exchanger, thereby facilitating cooling of the second temperature control fluid as it passes through the second zone, and wherein the first and second fans are disposed on one side of the heat exchanger, and the first fan is configured to push air through the heat exchanger and the second fan is configured to pull air through the heat exchanger.

19. The cooling system of claim 18, further comprising a valve operable to allow selective mixing of the first and second temperature control fluids, thereby facilitating heat transfer between the first and second temperature control fluids.

20. The cooling system of claim 18, further comprising a plurality of the first fan assemblies disposed proximate the first zone and including respective fans operable to move air across the first zone substantially independently of air moving across any other zone of the heat exchanger, at least one of the fans of the first fan assemblies being operable to push air through the heat exchanger.

21. The cooling system of claim 20, wherein at least one of the first fans is operable independently of at least one of the other first fans.

22. A cooling system for cooling a plurality of heat producing systems, the cooling system comprising:

a heat exchanger including first and second cooling zones, the first cooling zone including a first inlet for receiving a first temperature control fluid from a first of the heat producing systems and a first outlet for returning the first temperature control fluid to the first heat producing system, the second cooling zone including a second inlet for receiving a second temperature control fluid from a second of the heat producing systems and a second outlet for returning the second temperature control fluid to the second heat producing system;

a first fan assembly disposed proximate the first zone and including a first fan operable to move air across the first zone substantially independently of air moving across any other zone of the heat exchanger, thereby facilitating cooling of the first temperature control fluid as it passes through the first zone;

a second fan assembly disposed proximate the second zone and including a second fan independently operable from the first fan to move air across the second zone substantially independently of air moving across any other zone of the heat exchanger, thereby facilitating cooling of the second temperature control fluid as it passes through the second zone; and a valve operable to allow selective mixing of the first and second temperature control fluids, thereby facilitating heat transfer between the first and second temperature control fluids.

23. The cooling system of claim 22, wherein the heat exchanger further includes additional cooling zones, each of the additional cooling zones including an inlet and an outlet for facilitating the flow of a respective temperature control fluid through the respective cooling zone, each of the respective temperature control fluids facilitating temperature control of a respective heat producing system, the cooling system further comprising additional fan assemblies, each of the additional fan assemblies being disposed proximate a respective additional cooling zone and including a respective fan.

24. The cooling system of claim 22, further comprising a plurality of the first fan assemblies, each of the first fan assemblies being disposed proximate the first zone and including a respective fan operable to move air across the first zone substantially independently of air moving across any other zone of the heat exchanger.

25. The cooling system of claim 24, wherein at least one of the first fans is operable independently of at least one of the other first fans.

* * * * *